US005150480A

United States Patent [19]

Schmucki

[11] Patent Number: 5,150,480

[45] Date of Patent: Sep. 29, 1992

[54] SUPPORT FOOTING FOR TOILET

[75] Inventor: Peter Schmucki, Eschenbach, Switzerland

[73] Assignee: Geberit AG, Switzerland

[21] Appl. No.: 606,883

[22] Filed: Oct. 31, 1990

[30] Foreign Application Priority Data

Nov. 10, 1989 [CH] Switzerland ..... 4057/89

[51] Int. Cl.[5] ..... E03D 11/14

[52] U.S. Cl. ..... 4/252.3; 403/109; 403/362; 248/157

[58] Field of Search ..... 4/252 R; 248/157, 161, 248/188.2, 188.5, 188.8, 161, 413; 403/104, 109, 362; 211/175, 182, 190, 206

[56] References Cited

U.S. PATENT DOCUMENTS

| | | | |
|---|---|---|---|
| 1,425,072 | 8/1922 | Adams | 248/188.8 |
| 2,159,021 | 5/1939 | Groeniger | 4/252 R |
| 3,184,207 | 5/1965 | Hermanns et al. | 248/413 |
| 3,796,169 | 3/1974 | Bales et al. | 248/188.8 X |
| 3,858,989 | 1/1975 | Field | 403/362 X |
| 4,136,785 | 1/1979 | McDevitt | 211/190 |

FOREIGN PATENT DOCUMENTS

| | | | |
|---|---|---|---|
| 2451761 | 5/1976 | Fed. Rep. of Germany . | |
| 2457958 | 6/1976 | Fed. Rep. of Germany . | |
| 2639018 | 3/1978 | Fed. Rep. of Germany . | |
| 3327883 | 2/1985 | Fed. Rep. of Germany | 4/DIG. 7 |
| 2902318.8 | 5/1989 | Fed. Rep. of Germany . | |
| 0427678A1 | 11/1990 | Fed. Rep. of Germany . | |

OTHER PUBLICATIONS

Geberit (Handbook) pp. 6.31–6.32 1987.

*Primary Examiner*—Charles E. Phillips
*Attorney, Agent, or Firm*—McGlew & Tuttle

[57] ABSTRACT

The foot support (5) has an H-shaped beam (6) as well as two feet (7). The beam (6) and the feet (7) are made from metal pipes with rectangular cross section. The height of the foot support (5) is adjusted by adjusting the depth of insertion of the feet (7) into the beam (6). The feet (7) and the beam (6) have bent parts (7*a* and 6*c*) for fastening. The foot support (5) is also suitable for in-front-of-the-wall mounting and the in-the-wall mounting of the installation block. The feet (7) are inserted into the beam (6) such that its bent parts (7*a*) are directed toward the building wall (1) in the first case and away from the wall in the second case. The foot support (5) has a high load-bearing capacity and is particularly suitable for the installation of a wall-mounted toilet in front of a light-construction wall.

7 Claims, 1 Drawing Sheet

SUPPORT FOOTING FOR TOILET

FIELD OF THE INVENTION

The present invention pertains to a foot support or support footing, particularly for mounting flush tank installation blocks for toilets, in front of or in a building wall, wherein the foot support is fastened to the bottom of the installation block.

BACKGROUND OF THE INVENTION

In a prior-art kit for the in-front-of-the-wall installation of installation blocks, a foot support of this class consists of two frame-shaped supports, which are to be arranged at spaced locations from one another and consist of one U-shaped and two bent metal bands.

For the installation of a wall toilet, an abutment must be mounted on the floor flush with the cover.

In a kit for in-front-of-the-wall mounting or in-the-wall mounting, a pair of independent metal angles, which are to be placed vertically, are provided as the foot support or support footing. In the case of this in-front-of-the-wall mounting or in-the-wall mounting of the installation block, these foot supports serve only as mounting aids.

For the in-front-of-the-wall installation and the in-the-wall installation of installation blocks, it has consequently hitherto been necessary to use different foot supports and kits.

SUMMARY AND OBJECTS OF THE INVENTION

It is an object of the present invention is to provide a foot support of the above-described class, which is suitable for both types of installation and can also be produced at a lower cost.

According to the invention, a foot support or support footing is provided including an H-shaped beam element to vertically extending side supports. The side supports are formed of metal pipes having rectangular cross sections. These vertically extending supports are open at the bottom and have top portions which are bent. The two vertically extending side supports are arranged substantially in parallel to and at a spaced location from the building wall. Bent foot members are provided including vertical members bent at the bottom, the vertical members being pushed into the support to provide a height adjustment of the support. A fixing arrangement is provided for fixing the foot members relative to the supports.

The foot support according to the present invention has a high load-bearing capacity and is therefore also suitable for self-supporting mounting of relatively heavy installation blocks. The cover of a light-construction wall can highly advantageously be supported on the beam in this case. In the case of in-front-of-the-wall mounting or in- the-wall mounting, the feet are pushed into the beam such that the bent parts point approximately perpendicularly away from the building wall. Due to the high load-bearing capacity and the horizontal bracing of the two side supports, an abutment on the floor can be dispensed with in the case of a wall toilet.

According to a variant of the present invention, the foot support according to the present invention may additionally have an apron, which is screwed to the front side of the beam. This design is particularly suitable for the installation of an installation block for a wall-mounted toilet. Further advantageous characteristics will appear from the claims and the description.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
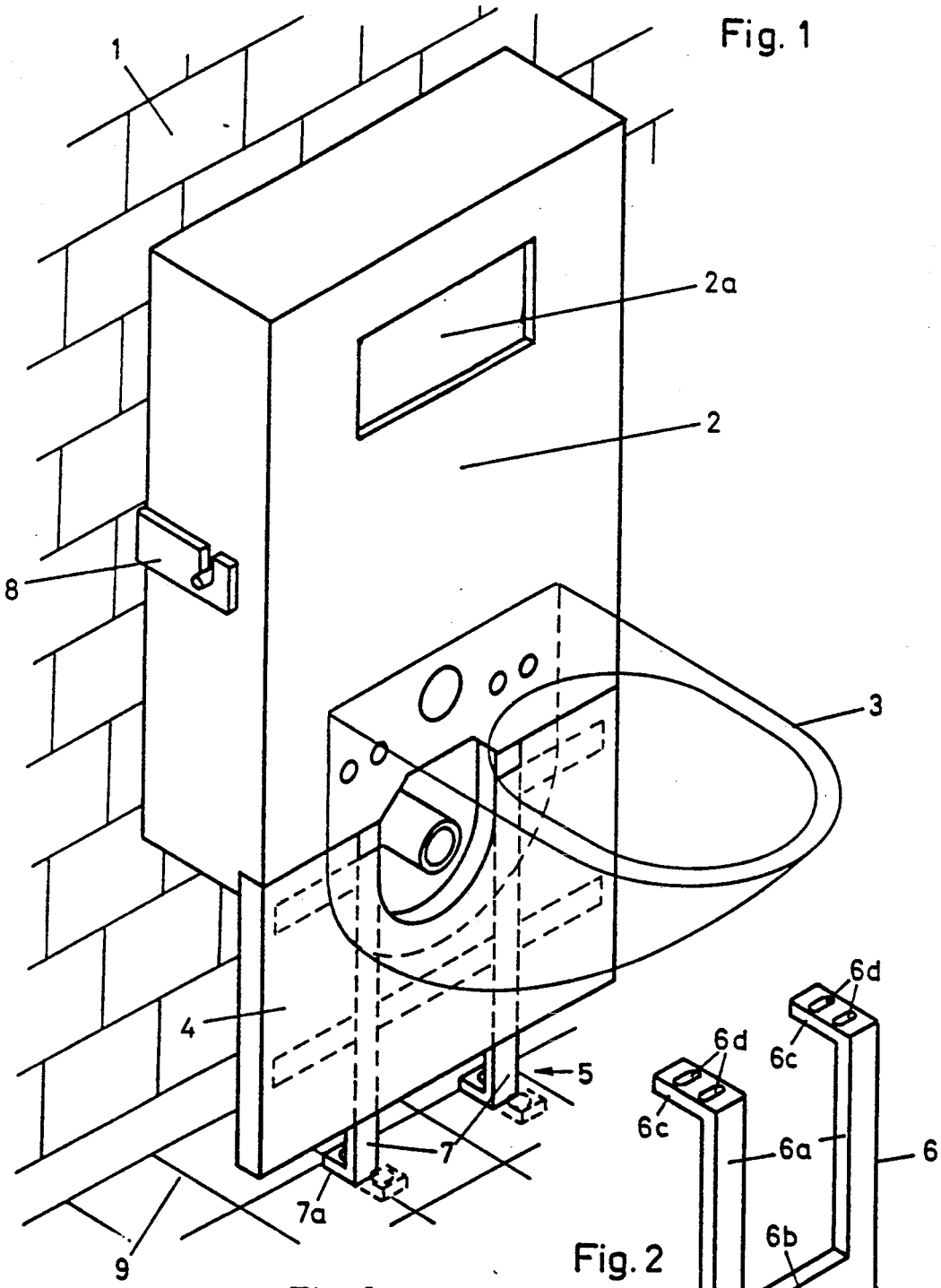
FIG. 1 is a perspective view of a foot support according to the present invention with a wall toilet mounted in front of a wall.

FIG. 1 shows a sanitation installation block 2, is fastened to a building wall 1 with a mounting strap 8 via a floor 9. The block 2 contains, e.g., a flush tank for a wall-mounted toilet 3. The flush tank is operated via an operating button 2*a* accessible on the front side. The installation block 2 has foam-embedded metal sections (not shown here), to which the cover of a light-construction wall is screwed.

Figure 2:
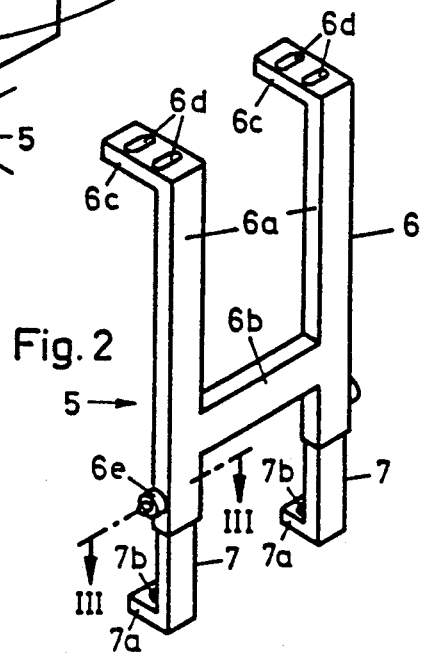
FIG. 2 is a perspective view of a foot support according to the present invention.

The installation block 2 stands on a support footing or foot support 5, which is screwed to the floor 9 and to the lower side of the installation block 2. As is shown in FIG. 2, the foot support 5 has an H-shaped beam 6, which is made from metal pipes with rectangular cross section. The beam 6 has two parallel side supports 6*a*, which are bent at the top and are permanently connected to each other by means of a horizontal web 6*b*. The bent parts 6*c*, which project at right angles to the wall, have two slotted holes 6*d* each, through which fastening bolts pass and which extend in parallel to the building wall 1.

Figure 3:
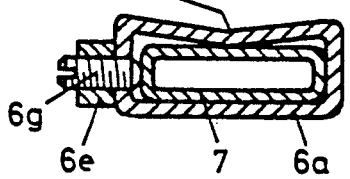
FIG. 3 is a cross sectional view through the foot support taken along III—III in FIG. 2.

Two feet 7, which are also made from metal pipes with rectangular cross section, are pushed into the side supports 6*a* from the bottom. The height of the foot support 5 and consequently the distance of the installation block 2 over the floor 9 are adjusted by setting the depth of insertion of the feet 7 in the beam 6. The clamping screws 6*g* are screwed into the nuts 6*e*, which are welded onto the side supports 6*a*. As is shown in FIG. 3, the side supports 6*a* are centrally depressed on one side in order to reduce the clearance. These depressions 6*f* extend essentially over the entire length of the side supports 6*a*. Consequently, the cross sections of the pipes of the side supports 6*a* and of the feed 7 need not exactly match each other, because differences can be absorbed due to depressions 6*f* of corresponding depth.

In the case of in-front-of-the-wall mounting shown in FIG. 1, the feet 7 are pushed into the beam 6 such that the bent parts 7*a* are directed toward the building wall 1. In the case of installation of the installation block with in-front-of-the-wall mounting or in-the-wall mounting, the feet 7 may be pushed into the beam 6 such that the parts 7*a* are directed away from the building wall 1, as shown by broken line in FIG. 1.

The foot support 5 has, together with the mounting strap 8, a high load-bearing capacity exceeding 400 kg.

Therefore, it is also suitable for mounting a wall-mounted toilet at a light-construction wall. As is shown in FIG. 1, an apron 4 is advantageously provided, which is screwed onto the front side of the foot support 5. Together with the apron 4, the foot support 5 forms the abutment for the bowl 3.

While a specific embodiment of the invention has been shown and described in detail to illustrate the application of the principles of the invention, it will be understood that the invention may be embodied otherwise without departing from such principles.

What is claimed is:

1. A foot support for mounting an installation block of a toilet arrangement in front of or in a building wall, comprising:

an H-shaped beam including two vertically extending side supports, said side supports being formed of metal pipe elements which are rectangular in cross section having two broad sides and two narrow sides, said metal pipe elements being formed open at the bottom and having bent top portions, said top portions being fastened to the installation block, said vertically extending side supports being exposed substantially in parallel to and at a spaced location from the building wall; foot elements including vertically extending generally rectangular members having two broad sides and two narrow sides and having bent foot members, said foot elements being inserted into corresponding ones of said open bottoms of adjusting the height of said H-shaped beam; and, fixing means for fixing said foot elements relative to said H-shaped beam, said side supports include a broad side with a depression substantially in the middle of said broad side, said depression extending in a longitudinal direction of said side support, thereby reducing the clearance between said side supports and said vertically extending members of said foot elements when said members are inserted in said side supports, wherein said fixing means are threaded into one of the narrow sides of said vertically extending side supports so as to engage a narrow side of said foot elements and clamp said foot elements between said fixing means, said depression, one broad side and one narrow side of said vertically extending side supports.

2. A foot support according to claim 1, wherein said foot elements are formed from metal pipes having rectangular cross sections.

3. A foot support according to claim 1, wherein said bent foot members include slotted holes for adjusting the distance from the building wall.

4. A foot support according to claim 1, wherein said bent top portion of said beam include longitudinal slots extending in parallel to the building wall.

5. A foot support according to claim 1, further comprising an apron member extending in parallel to said building wall fastened to a front side of said H-shaped beam, a toilet bowl mounted to the toiled arrangement, said apron member forming an abutment surface for said toilet bowl.

6. A foot support according to claim 1 further comprising a mounting strap connected to the building wall and fastenably connecting the installation block to the building wall.

7. A foot support according to claim 1, further comprising:

an apron member fastened to a front side of said H-shaped beam forming a smooth continuous surface with said installation block.

* * * * *